US010405083B2

(12) United States Patent
Bullimore

(10) Patent No.: US 10,405,083 B2
(45) Date of Patent: Sep. 3, 2019

(54) LOUDSPEAKER ASSEMBLY

(71) Applicant: Tymphany HK Limited, Wanchai (HK)

(72) Inventor: George Bullimore, Wales (GB)

(73) Assignee: TYMPHANY HK LIMITED, Wanchai (HK)

( * ) Notice: Subject to any disclaimer, the term of this patent is extended or adjusted under 35 U.S.C. 154(b) by 0 days.

(21) Appl. No.: 15/712,893

(22) Filed: Sep. 22, 2017

(65) Prior Publication Data

US 2018/0091891 A1 Mar. 29, 2018

Related U.S. Application Data

(60) Provisional application No. 62/399,299, filed on Sep. 23, 2016.

(51) Int. Cl.

| | |
|---|---|
| ***H04R 1/20*** | (2006.01) |
| ***H04R 1/28*** | (2006.01) |
| ***H04R 1/22*** | (2006.01) |
| ***H04R 1/40*** | (2006.01) |
| ***H04R 1/32*** | (2006.01) |
| *H04R 1/02* | (2006.01) |
| *H04R 1/26* | (2006.01) |

(52) U.S. Cl.

CPC ..... *H04R 1/2819* (2013.01); *H04R 1/227* (2013.01); *H04R 1/2861* (2013.01); *H04R 1/323* (2013.01); *H04R 1/403* (2013.01); *H04R 1/023* (2013.01); *H04R 1/26* (2013.01); *H04R 1/2865* (2013.01); *H04R 2201/34* (2013.01); *H04R 2201/403* (2013.01)

(58) Field of Classification Search

CPC ..... H04R 1/023; H04R 1/227; H04R 1/26; H04R 1/2819; H04R 1/2861; H04R 1/2865; H04R 1/323; H04R 1/403; H04R 2201/34; H04R 2201/403

USPC ..... 381/338

See application file for complete search history.

(56) References Cited

U.S. PATENT DOCUMENTS

| | | | | |
|---|---|---|---|---|
| 8,130,994 | B2 * | 3/2012 | Button | H04R 1/24 181/155 |
| 2007/0147647 | A1 * | 6/2007 | Voishvillo | H04R 1/30 381/343 |
| 2009/0310808 | A1 * | 12/2009 | Button | H04R 1/24 381/339 |
| 2013/0064414 | A1 * | 3/2013 | Flavignard | H04R 1/24 381/412 |
| 2015/0271591 | A1 * | 9/2015 | Monroe | H04R 1/22 381/98 |

* cited by examiner

*Primary Examiner* — Khai N. Nguyen
(74) *Attorney, Agent, or Firm* — Cantor Colburn LLP

(57) ABSTRACT

A speaker waveguide includes a first orifice arranged about a rotational axis of the waveguide, a waveguide region that extends radially outwardly from the first orifice, and a bracket region defining a second orifice and a third orifice.

24 Claims, 5 Drawing Sheets

LOUDSPEAKER ASSEMBLY

CROSS-REFERENCE TO RELATED APPLICATIONS

This application claims priority to provisional application No. 62/399,299, filed Sep. 23, 2016; the entire contents of which are incorporated herein by reference.

TECHNICAL FIELD

The present disclosure relates to audio applications, and more specifically, to a to a speaker assembly having a configuration for optimizing audio output.

BACKGROUND

Many common electronic devices require smaller loudspeaker assemblies. Yet consumers increasingly demand high quality and consistent audio output from such loudspeakers at a reduced cost.

What is needed is speaker assembly which is reduced in size but yet provides sufficient audio output quality at a lesser expense.

SUMMARY

According to an exemplary embodiment, a speaker waveguide includes a first orifice arranged about a rotational axis of the waveguide, a waveguide region that extends radially outwardly from the first orifice, and a bracket region defining a second orifice and a third orifice.

According to another exemplary embodiment, a speaker assembly includes a first speaker and a speaker waveguide arranged on the first speaker. The speaker waveguide includes a first orifice arranged about a rotational axis of the waveguide, a waveguide region that extends radially outwardly from the first orifice, and a bracket region defining a second orifice and a third orifice.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
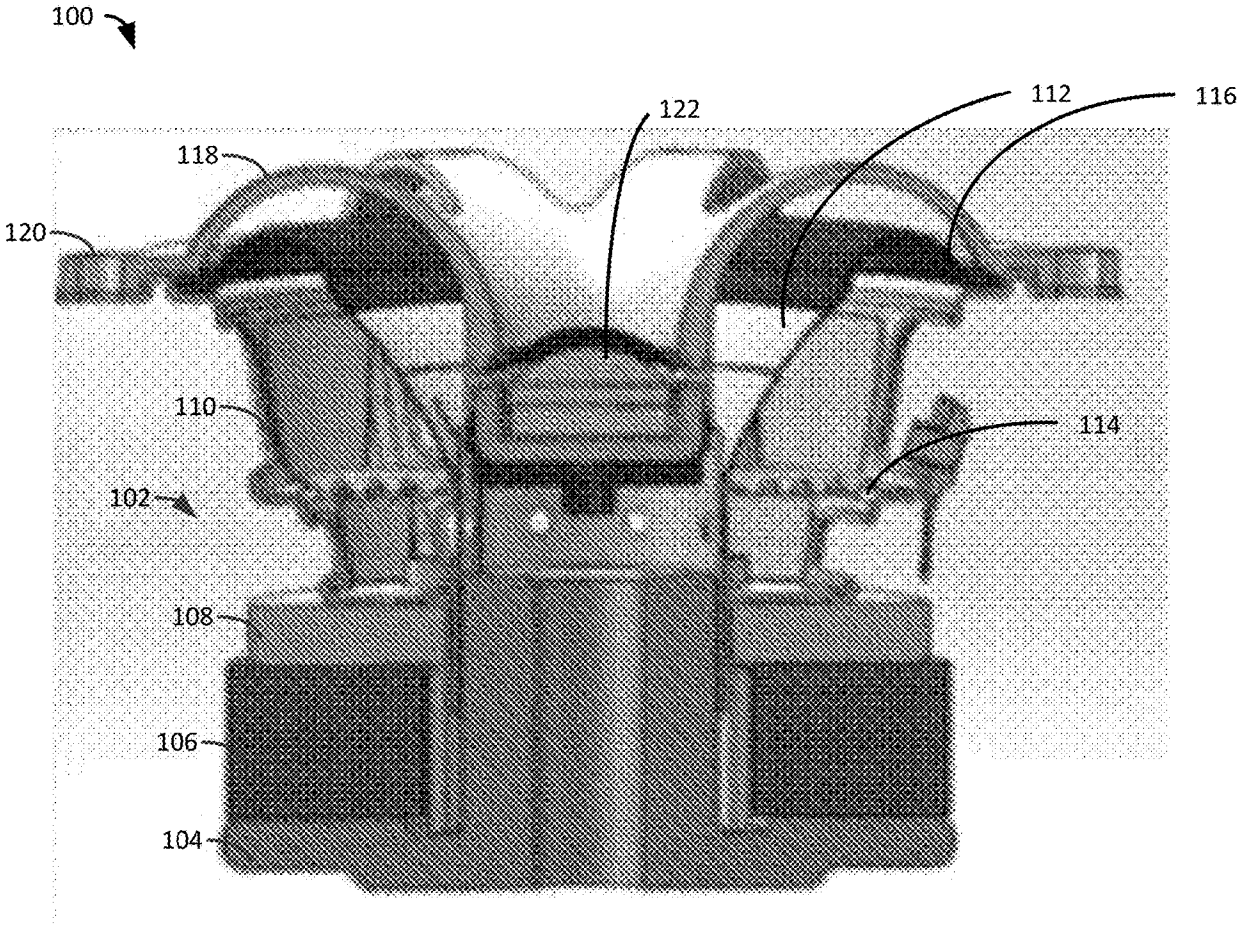
FIG. 1 illustrates a side cut-away view of an exemplary embodiment of a speaker assembly (assembly).

FIG. 1 illustrates a side cut-away view of an exemplary embodiment of a speaker assembly (assembly) 100. The assembly 100 includes a low frequency transducer woofer assembly 102 that includes a yoke 104, a magnet 106, and a top plate 108. A basket 110 is arranged on the top plate 108.

A cone 112 is connected to a voice coil, a spider 114 and suspension 116 provide support for the cone 112.

It is desirable to provide a compact speaker configuration that provides both low frequency output from a first speaker such as the woofer assembly 102 and from a second speaker such as from a higher frequency transducer outputting tweeter type speaker.

In this regard, the assembly 100 includes a waveguide assembly (waveguide) 118 that is connected to the assembly 100 using, for example, fasteners that pass through the attachment regions 120. The waveguide assembly 118 secures a tweeter assembly (second speaker) 122 substantially coaxially with the woofer assembly (first speaker) 102. The waveguide 118 has cutout regions (described below) that allow for the waveguide 118 to be substantially acoustically transparent to the low-frequency sound produced by the woofer assembly 102.

Figure 2:
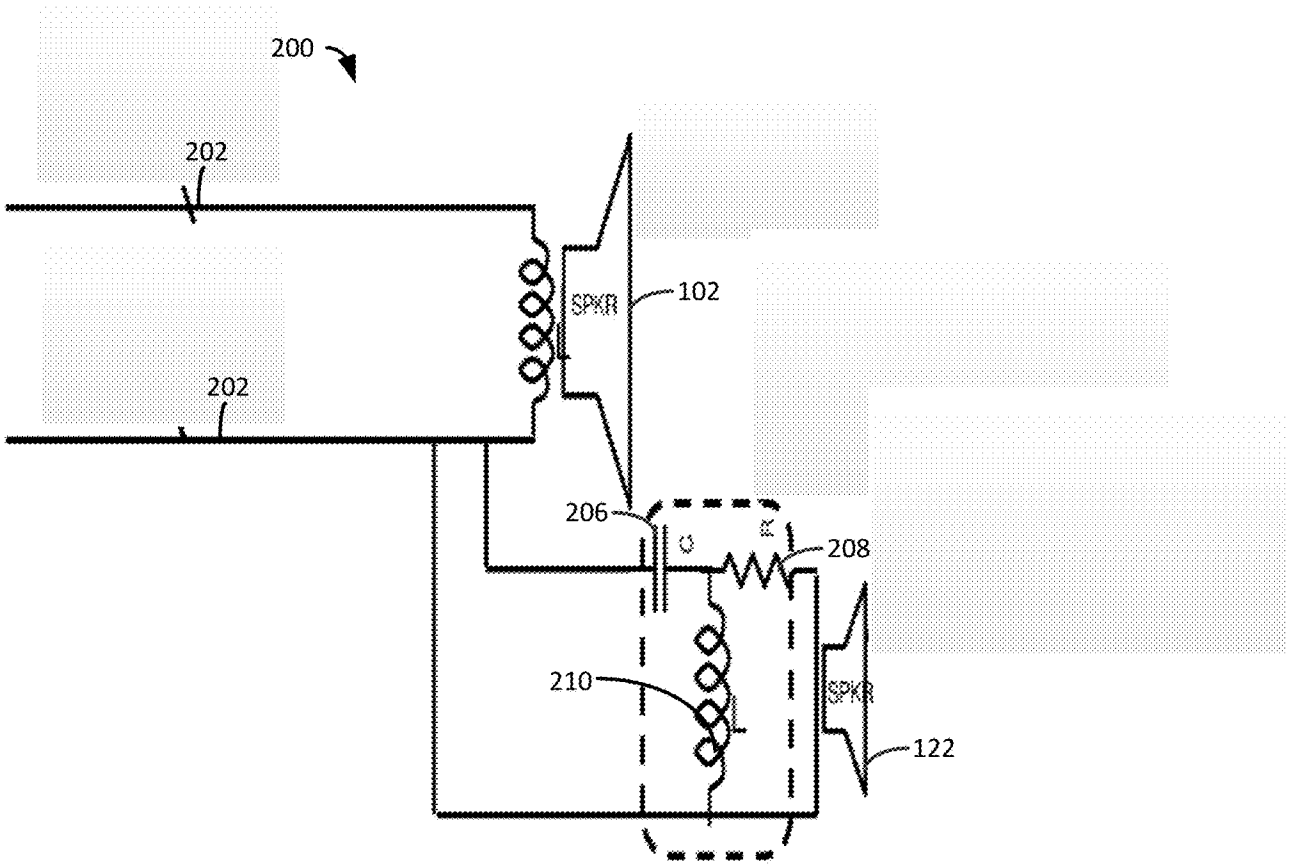
FIG. 2 illustrates a circuit diagram of an exemplary embodiment of a circuit that may be arranged in the assembly.

FIG. 2 illustrates a circuit diagram of an exemplary embodiment of a circuit 200 that may be arranged in the assembly 100. The circuit 200 includes terminals 202 that are connected to the woofer assembly 102. The terminal 202 is communicatively connected to the tweeter assembly 122 via a capacitor 206 and a resistor 208 that are arranged in series with the tweeter assembly 122. An inductor 210 is arranged in parallel with the tweeter assembly 122.

Figure 3:
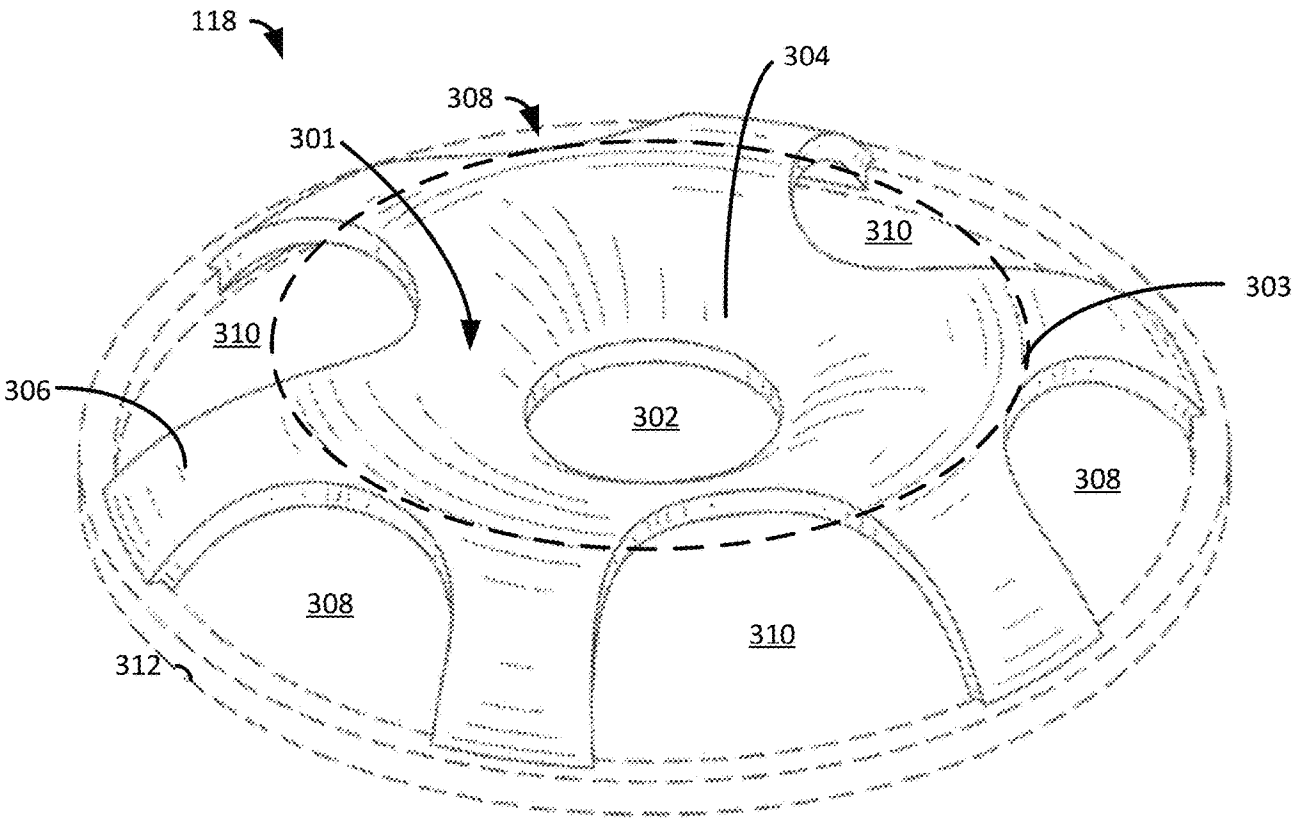
FIG. 3 illustrates a perspective view of an exemplary embodiment of a waveguide.
Figure 4:
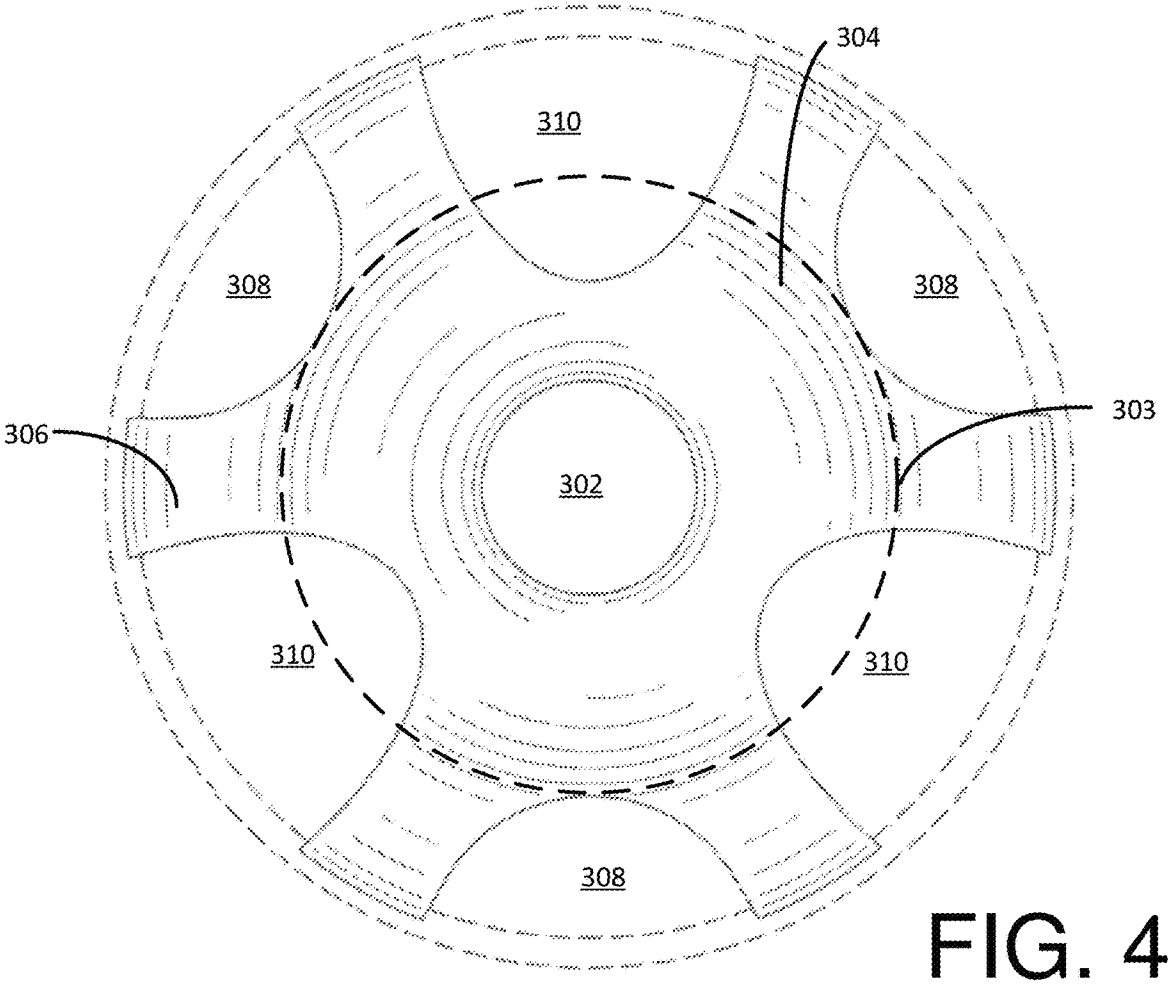
FIG. 4 illustrates a top view of the exemplary embodiment of the waveguide.

FIG. 3 illustrates a perspective view and FIG. 4 illustrates a top view of an exemplary embodiment of the waveguide 118. The waveguide 118 includes a speaker opening region 302 that is arranged substantially in the center of the waveguide 118. An outer ring 312 defines an outer diameter of the waveguide 118. The speaker opening region 302 provides a region that engages the tweeter assembly 122. The speaker opening region 302 may include brackets or other engagement or mounting points to secure the tweeter assembly 122 to the waveguide 118. The radius of speaker opening region 302 is smaller than the radius of the cone 112 (of FIG. 1). The area of the speaker opening region 302 is between 4% to 7% of the surface area of the waveguide 118.

The waveguide 118 includes a waveguide portion 304 that is arranged inside the circle 303. The circle 303 is shown at the highest point of the waveguide assembly 118. The waveguide portion 304 has a parabolically shaped or curved, substantially smooth surface 301 without openings or abrupt geometries. The waveguide portion 304 is operative to help to guide high-frequency sound waves generated by the tweeter assembly 122. This improves the efficiency of the radiation of the sound waves and limits direct acoustic artifacts as a result of interaction between the radiations of the tweeter assembly 122 and the woofer assembly 102.

The waveguide portion 304 has a conical geometry raising the profile of the waveguide following a parabolic function from the speaker opening region 302 towards the top of the waveguide 118.

Experimental studies show that the diameter of this concentric and continuous waveguide portion 304 is between 35% to 45% of the waveguide 118 diameter. This corresponds to the following ratio (WD/BROD) between the Waveguide Diameter (WD) and the Bracket Region Outer Diameter (BROD): ranging from 2.8 to 3.2. For example, in a 3.5 inch waveguide with a diameter of 80 mm, the waveguide portion 304 region is defined from the outer diameter edge of the speaker opening region 302 to a concentric circle with a diameter between 28-36 mm. This region acts as a waveguide. In the illustrated exemplary embodiment the outer diameter of the waveguide 118 corresponds to the outer diameter of the woofer assembly 102.

The waveguide 118 includes a bracket region 306. The bracket region 306 is operative to provide structural support for the tweeter assembly 122 (of FIG. 1). The bracket region 306 is also operative to act as a low-pass filter, which allows low frequency sound waves emitted by the woofer assembly 102 to pass through orifices 308 and 310 arranged in the waveguide 118. The bracket region 306 acts as a prolongation of the waveguide portion 304 assisting with the high frequency guidance, and providing a better coupling for the acoustic radiated energy.

Figure 5:
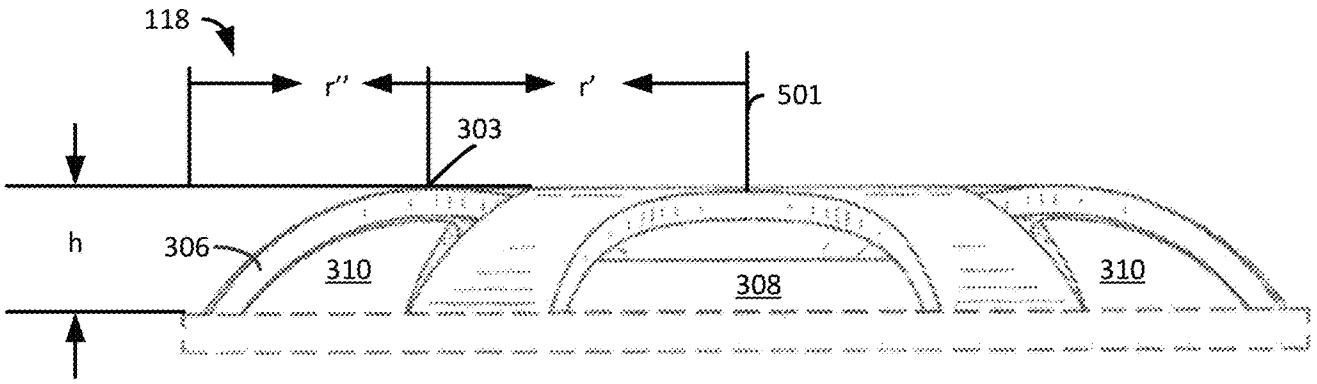
FIG. 5 illustrates a side view of the waveguide.

FIG. 5 illustrates a side view of the waveguide 118. The bracket region 306 is arranged with a few parameters. The highest point 303 of the waveguide 118 is located in the bracket region 306 such that the waveguide 118 has a height (h). The highest point 401 of the waveguide 118 is concentrically arranged on the waveguide 118 and is closer radially to the waveguide portion 304 (of FIG. 3) than to the outer diameter of the waveguide 118. In this regard, the radius r' is less than the radius r". A rotational axis of the waveguide 118 is illustrated by the line 501.

The dimensions or relationship between the dimensions of the diameter of the waveguide portion 304 (r') and the height (h) may be expressed as a ratio of the r' divided by the h. Where the ratio is between 5 and 7. For example, for a 3.5 inch woofer with an outer diameter of 80 mm, a waveguide of similar size is used, 80 mm. Therefore, waveguide 118 h dimension falls between 11 mm (80×0.14) and 16 mm (80×0.2). In other words, this waveguide design would increase the total profile height of the woofer less than 20% of the outer diameter of the woofer.

There are an even number of orifices 308 and 310, and the orifices 308 and 310 are different sizes and shapes respectively where the orifice 308 has a smaller opening area than the orifice 310. The orifices 308 and 310 are arranged in an alternating pattern about the center of the waveguide 118. The orifices 310 (the larger orifices) extend radially inward through the circle 303 (highest point of the waveguide 118), thus the circle 303 may not be continuous. The width of the orifices 310 becomes wider as the orifices 310 approach the outer diameter of the waveguide 118.

The smaller orifices 308 begin at the point 303 (moving radially outward from the center of the waveguide 118) and become wider as the orifices 308 approach the outer diameter of the waveguide 118. The width of the orifices 308 at the outer diameter of the waveguide 118 may be greater than the corresponding widths of the orifices 310 at the outer diameter of the waveguide 118.

The areas of the orifices 308 and 310 may be expressed as a ratio of the area of a large orifice (orifice 310) divided by the area of a small orifice (orifice 308). The ratio is between 1.3 to 1.9. For example, if a 3.5 inch waveguide of 80 mm diameter is designed with each orifice 308 having an area of 300 $mm^2$, the area of each orifice 310 would range from 390 $mm^2$ to 570 $mm^2$.

The combined areas of the orifices 308 and 310 and the total area of the waveguide 118 may be expressed as a ratio of the total wave guide area divided by the sum of the areas of the orifices 308 and 310. The ration is between 1.9 to 2.5. For example, a 3.5 inch waveguide with a diameter of 80 mm has an area of approximately 5000 $mm^2$. Using the above ration, the sum of the areas of the orifices 308 and 310 range from approximately 2010 $mm^2$ to 2645 $mm^2$.

Figure 6:
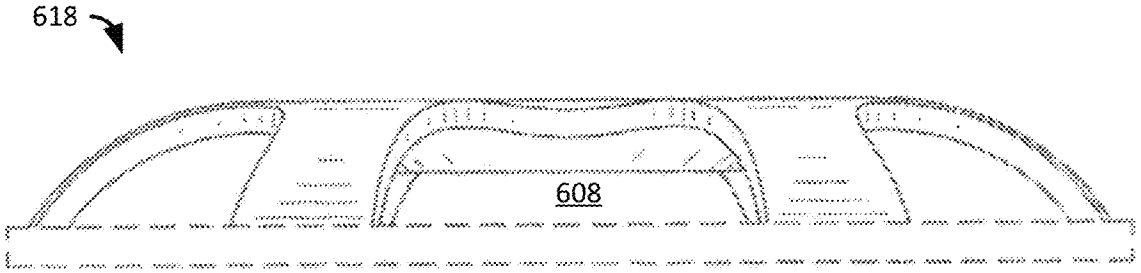
FIG. 6 illustrates a side view of an alternate embodiment of a waveguide.

FIG. 6 illustrates a side view of an alternate embodiment of a waveguide 518. The waveguide 518 has an orifice 508 with an undulating profile.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A speaker waveguide comprising:
- a first orifice arranged about a rotational axis of the waveguide;
- a waveguide region that extends radially outwardly from the first orifice; and
- a bracket region defining a plurality of second orifices and a plurality of third orifices;
- wherein the second orifices have a common size;
- wherein the third orifices have a common size;
- wherein the size of the third orifices is greater than the size of the second orifices; and
- wherein the second and third orifices are arranged in the waveguide circumferentially around the first orifice in an alternating fashion.

2. The speaker waveguide of claim 1, wherein the first orifice is operative to receive a first speaker.

3. The speaker waveguide of claim 2, wherein the parabolic shape rises radially from the first orifice to a highest point of the waveguide which comprises a circle concentric with the first orifice from which the bracket region descends to an outer circumference of the waveguide, the bracket region configured to provide structural support for an installation of the waveguide.

4. The speaker waveguide of claim 3, wherein the second orifices abut the circle and extend to the outer circumference of the waveguide and the third orifices intersect the circle in a direction toward the first orifice and extend to the outer circumference in an opposite direction.

5. The speaker waveguide of claim 1, wherein the waveguide region has a parabolically shaped surface profile.

6. The speaker waveguide of claim 1, wherein the second orifice has a greater area than the third orifice.

7. The speaker waveguide of claim 1, wherein the second orifice and the third orifice are operative to allow low frequency sound waves to pass through the speaker waveguide.

8. The speaker waveguide of claim 1, further comprising an outer ring having a region operative to attach to a second speaker assembly.

9. The speaker waveguide of claim 1, wherein the waveguide has a height (h) and the waveguide region has a radius (r), where a ratio of r:h is between 5 to 7.

10. The speaker waveguide of claim 1, wherein an area of the first orifice is between 4% to 7% of a surface area of the waveguide.

11. The speaker waveguide of claim 1, wherein a diameter of the waveguide region is between 35% to 45% of the diameter of the speaker waveguide.

12. The speaker waveguide of claim 1, wherein a ratio of areas of the second orifice to the third orifice is between 1.3 to 1.9.

13. A speaker assembly comprising:
- a first speaker; and
- a speaker waveguide arranged on the first speaker, the speaker waveguide comprising:
  - a first orifice arranged about a rotational axis of the waveguide;
  - a waveguide region that extends radially outwardly from the first orifice; and
  - a bracket region defining a plurality of second orifices and a plurality of third orifice;

wherein the second orifices have a common size;

wherein the third orifices have a common size;

wherein the size of the third orifices is greater than the size of the second orifices; and wherein the second and third orifices are arranged in the waveguide circumferentially around the first orifice in an alternating fashion.

14. The assembly of claim 13, wherein the first orifice is operative to receive a first speaker.

15. The assembly of claim 13, wherein the waveguide region has a parabolically shaped surface profile.

16. The assembly of claim 15, wherein the parabolic shape rises radially from the first orifice to a highest point of the waveguide which comprises a circle concentric with the first orifice from which the bracket region descends to an outer circumference of the waveguide, the bracket region configured to provide structural support for the speaker.

17. The speaker waveguide of claim 16, wherein the second orifices abut the circle and extend to the outer circumference of the waveguide and the third orifices intersect the circle in a direction toward the first orifice and extend to the outer circumference in an opposite direction.

18. The assembly of claim 13, wherein the second orifice has a greater area than the third orifice.

19. The assembly of claim 13, wherein the second orifice and the third orifice are operative to allow low frequency sound waves to pass through the speaker waveguide.

20. The assembly of claim 13, further comprising an outer ring having a region operative to attach to a second speaker assembly.

21. The assembly of claim 13, wherein the waveguide has a height (h) and the waveguide region has a radius (r), where a ratio of r:h is between 5 to 7.

22. The assembly of claim 13, wherein an area of the first orifice is between 4% to 7% of a surface area of the waveguide.

23. The assembly of claim 13, wherein a diameter of the waveguide region is between 35% to 45% of the diameter of the speaker waveguide.

24. The assembly of claim 13, wherein a ratio of areas of the second orifice to the third orifice is between 1.3 to 1.9.

* * * * *